US009664065B2

(12) United States Patent
Feldmann et al.

(10) Patent No.: US 9,664,065 B2
(45) Date of Patent: May 30, 2017

(54) CLAMPING RING FOR A TURBOMACHINE

(71) Applicant: MTU Aero Engines AG, Munich (DE)

(72) Inventors: Manfred Feldmann, Elchenau (DE); Norbert Schinko, Munich (DE); Sebastian Kaltenbach, Munich (DE); Christian Eichler, Munich (DE)

(73) Assignee: MTU Aero Engines AG, Munich (DE)

( * ) Notice: Subject to any disclaimer, the term of this patent is extended or adjusted under 35 U.S.C. 154(b) by 574 days.

(21) Appl. No.: 13/960,938

(22) Filed: Aug. 7, 2013

(65) Prior Publication Data

US 2014/0044538 A1 Feb. 13, 2014

(30) Foreign Application Priority Data

Aug. 9, 2012 (EP) ..... 12179765

(51) Int. Cl.
*F01D 25/24* (2006.01)
*F01D 9/04* (2006.01)

(52) U.S. Cl.
CPC ..... *F01D 25/24* (2013.01); *F01D 9/042* (2013.01); *F01D 25/246* (2013.01); *F05D 2230/60* (2013.01); *F05D 2240/11* (2013.01); *F05D 2260/30* (2013.01)

(58) Field of Classification Search
CPC ..... F01D 11/001; F01D 11/005; F01D 11/12; F01D 11/122; F01D 11/125; F01D 11/127; F01D 11/08; F01D 9/04; F01D 9/041; F01D 25/145; F01D 25/246
USPC ... 415/189, 190, 209.2, 209.3, 209.4, 210.1, 415/173.3, 173.5, 173.4, 178, 177, 241.1
See application file for complete search history.

(56) References Cited

U.S. PATENT DOCUMENTS 4,925,365 A * 5/1990 Crozet ..... F01D 9/04 277/415
5,228,828 A 7/1993 Damlis et al.
5,662,457 A * 9/1997 Bechtel ..... F01D 25/145 29/889.2
6,668,559 B2 12/2003 Calvez et al.
6,966,758 B2 11/2005 Grabau et al.
7,334,984 B1 * 2/2008 Stine ..... F01D 11/127 415/173.1
7,442,004 B2 10/2008 Ruthemeyer et al.
7,866,943 B2 1/2011 Durand et al.
(Continued)

FOREIGN PATENT DOCUMENTS

DE 19958809 6/2001
DE 19958809 A1 * 6/2001 ..... F01D 11/08
(Continued)

OTHER PUBLICATIONS

DE 19958809, Machine Translation, Provided on Feb. 1, 2016.*

*Primary Examiner* — Patrick Maines
(74) *Attorney, Agent, or Firm* — Davidson, Davidson & Kappel, LLC

(57) ABSTRACT

A turbomachine having a flow channel (6) and a housing (1, 2) which radially surrounds the flow channel, at least one sealing or lining element (11) being situated between the flow channel and the housing, at least one clamping ring (14) being provided, which is situated circumferentially around the flow channel and which is situated in such a way that it abuts at least one contact surface (22) of the at least one sealing or lining element (11).

17 Claims, 1 Drawing Sheet

(56) References Cited

U.S. PATENT DOCUMENTS

| | | | | |
|---|---|---|---|---|
| 2004/0213666 | A1* | 10/2004 | Gieg | F01D 25/246 415/170.1 |
| 2007/0231132 | A1* | 10/2007 | Durand | F01D 11/12 415/209.2 |
| 2008/0075584 | A1* | 3/2008 | Philippot | F01D 11/18 415/173.1 |

FOREIGN PATENT DOCUMENTS

| | | | | |
|---|---|---|---|---|
| DE | 10122464 | C1 | 3/2002 | |
| EP | 0134186 | A1 * | 3/1985 | F01D 25/246 |
| EP | 0487193 | | 5/1992 | |
| EP | 1106785 | A1 * | 6/2001 | F01D 11/08 |
| EP | 1265037 | | 12/2002 | |
| EP | 1847686 | | 10/2007 | |
| EP | 2540994 | | 1/2013 | |
| GB | 2480766 | | 11/2011 | |
| JP | 2012225242 | A * | 11/2012 | |
| WO | WO0075492 | | 12/2000 | |

* cited by examiner

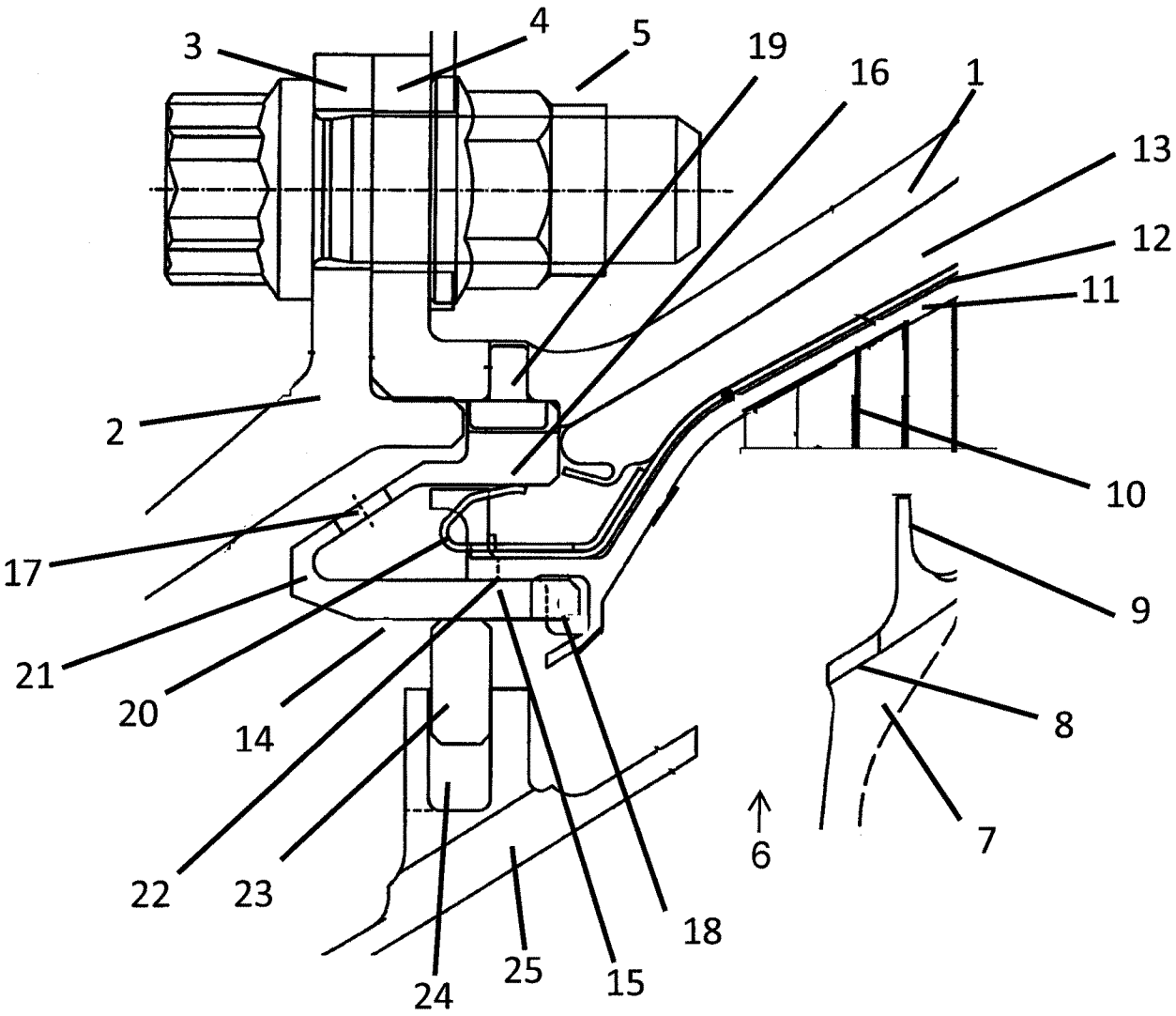
1
2
3
4
5
6
7
8
9
10
11
12
13
14
15
16
17
18
19
20
21
22
23
24
25

CLAMPING RING FOR A TURBOMACHINE

This claims the benefit of European Patent Application EP 12179765.8, filed Aug. 9, 2012 and hereby incorporated by reference herein.

The present invention relates to a turbomachine, in particular a thermal turbomachine, such as an aircraft engine or a stationary gas turbine, which has a flow channel for a fluid and a housing which radially surrounds the flow channel, at least one sealing or lining element being situated between the flow channel and the housing.

BACKGROUND

Thermal turbomachines such as gas turbines or jet engines have long been known. In these machines, a fluid is generated from combustion gases, with the aid of fuel combustion, this fluid driving rotors to rotation for the purpose of thereby generating energy or propulsion. The combustion gases in the flow channel usually have very high temperatures, so that lining elements, heat protection panels and/or cooling channels as well as insulating elements are provided between the flow channel and the housing of the turbomachine for the purpose of adjusting a steep temperature gradient from the flow channel to the housing.

Furthermore, the shell radially surrounding the flow channel must also ensure that fluid can possibly not escape from the flow channel, so that, if possible, all the combustion gases are available for driving the rotors. In certain circumstances, however, this is difficult to accomplish, due to the complex structure of the shell, including the housing, heat protection panels, lining elements and components for cooling air channels, since many different components must be connected to each other. As a result, gaps and cavities may easily form, through which both fluid may escape from the flow channel and cooling air may penetrate the flow channel. For this reason, it is important when designing the shell around the flow channel to make sure that sealing surfaces are provided between the individual components, which avoid leaks with regard to the flow channel.

According to the prior art, metallic spring elements are provided for this purpose, which are situated on the sealing surfaces of the different components for the purpose of generating a contact force, so that the adjacent components are pressed against each other on the sealing surface to thereby achieve a sealing effect. However, this results in the problem that high temperatures occur in the thermal turbomachines during operation, so that the metallic spring elements are also heated. Due to the thermal heating, the elastic spring forces may be at least partially reduced by plastic deformation, so that the spring elements lose their spring force, or the spring force is reduced. This results in the function of the spring elements for pressing against the sealing surfaces no longer being guaranteed during operation.

SUMMARY OF THE INVENTION

It is an object of the present invention to eliminate the problems from the prior art and, in particular, to provide a turbomachine which has a shell for a flow channel in which the sealing effect of the shell may be ensured even during operation at high temperatures. However, a corresponding turbomachine should have a simple structure and be easy to manufacture.

The present invention provides that a reliable sealing of the flow channel may be ensured if a clamping ring is provided in combination with a sealing and/or lining element, this clamping ring being situated circumferentially around the flow channel and being situated in such a way that it abuts at least one contact surface of the sealing and/or lining element which acts as a sealing surface.

The clamping ring may be situated, already under compression stress, in the housing which surrounds the flow channel on the outside, i.e., it may be incorporated in the form of a tension ring or be situated in the relaxed state without any significant compression application. Accordingly, the clamping ring may also be designed as an open or closed ring, an open ring being understood to be a ring which, like a tension ring, has an interruption in the circumferential direction for the purpose of changing the curvature radius and thus the internal stress of the ring by changing the position of the ends of the open ring.

In a clamping arrangement of the clamping ring or an arrangement of the clamping ring under compression stress, a pressing on the contact surface of the sealing and/or lining element may be provided by the applied compression stress.

Additionally or alternatively, the clamping ring may be situated in such a way that the clamping ring is heated by the operating temperature during operation of the turbomachine, and the clamping ring thermally expands due to the heating. The thermal expansion is used for moving the clamping ring, or at least parts thereof, in the direction of the contact surface of the sealing and/or lining element to maintain or even increase the contact force or to avoid the formation of gaps or the like. The negative phenomenon of the spring elements according to the related art, in the sealing effect being reduced by the increase in temperature during operation, is accordingly reversed, and the thermal expansion is used to achieve an improved contact of the sealing surfaces, i.e., the contact surface of the sealing and/or lining element on the clamping ring, and thus to increase the sealing effect during operation.

The clamping ring may be designed in such a way that it has an outer ring and an inner ring which are spaced a distance apart in the radial direction, i.e., in the direction of the longitudinal extension of the rotor blades.

At least one clamping element may be situated between the outer ring and the inner ring, which is held under elastic tension between the inner ring and the outer ring. With the aid of the clamping element, the sealing and/or lining element may be held in a clamped manner between the outer ring and inner ring in such a way that a contact force for pressing the contact surface of the sealing and/or lining element onto the clamping ring is also provided by the clamping element.

The contact surface of the sealing and/or lining element may abut the outside of the inner ring, and the outer ring and the inner ring may be connected to each other by an annular web in such a way that the clamping ring has a C-shaped cross section. The C-shaped cross section is used, on the one hand, to accommodate the clamping element described above as well as the sealing and/or lining element and, on the other hand, to facilitate the clamping ring in such a way that the distance between the outer ring and inner ring is variable at least in relation to the free front ends.

For this purpose, the annular web may have a kink or a curved area, so that at least the inner ring may be pivoted in relation to the curved area or the kink. As a result, due to the arrangement of the inner ring near the flow channel, the inner ring is heated to a higher temperature during operation than the outer ring, which is situated at a greater distance from the flow channel, so that the thermal expansion of the inner ring is greater than the thermal expansion of the outer ring. Accordingly, the inner ring may undergo greater thermal deformation than the outer ring, due to its ability to vary its distance from the outer ring, so that the inner ring may be used to maintain the contact with the contact surface of the sealing and/or lining element, while the outer ring is used to position the clamping ring in the housing, since its thermal expansion is less pronounced.

The sealing and/or lining elements may be designed in such a way that they counteract the thermal expansion of the clamping ring, so that high contact forces may be implemented due to the buildup of a counterpressure. This make take place, for example, by integrally connecting the webs to the sealing and/or lining elements which prevent a deformation of the sealing and/or lining elements in the same direction as the clamping ring.

The clamping ring may be manufactured from the same material as, for example, the housing elements on which the clamping ring is situated to avoid different thermal expansions. However, the clamping ring may also be manufactured from other materials.

The clamping ring may be designed as a separate ring, or it may be designed to form a single piece with adjacent components, e.g., adjacent housing components. A corresponding annular shape may be provided by machining, e.g., turning, the housing or the housing components. Likewise, the clamping ring may also have a segmented design, i.e., it may be designed to surround the flow channel only partially or only in sections. In this case, care must only be taken to ensure that the ends of the clamping ring segments are held in such a way that a corresponding radial widening of the clamping ring may be produced during a thermal expansion.

BRIEF DESCRIPTION OF THE DRAWING

The FIGURE shows a purely schematic representation of a partial axial sectional view of the housing and the flow channel of a turbomachine, for example an aircraft engine.

DETAILED DESCRIPTION

The FIGURE shows two segments 1, 2 of a housing of a turbomachine, for example an aircraft engine, which are connected to each other on adjoining flange sections 3, 4 with the aid of screw connections 5. The housing surrounds a flow channel 6, in which a rotor having a rotor blade 7 is situated, which is driven by the flow of a fluid, such as combustion gases, through flow channel 6. Partially illustrated rotor blade 7 includes a shroud 8 on which a seal tip 9 is provided, which is able to engage with a run-in coating 10 or a sealing structure when rotor blade 7 is lengthened radially during operation of the turbomachine, due to heating and centrifugal forces.

The run-in coating or sealing structure 10 is situated on a lining segment 11 which separates flow channel 6 from housing 1. Extending from lining segment 11, a heat protection panel 12 and an insulation 13 are furthermore provided radially in the direction of housing 1, for the purpose of protecting housing 1 against the high temperatures in flow channel 6. Flow channels for cooling air may be provided between the housing and lining segment 11 for the purpose of further cooling housing segment 1.

To avoid a loss of cooling air in flow channel 6 or a loss of fluid from the flow channel and a loss of performance associated therewith, lining segment 11 must seal the flow channel as effectively as possible.

To achieve this, a clamping ring 14 is provided according to the present invention, which has a C-shaped cross-sectional structure. Accordingly, clamping ring 14 includes an inner ring 15, which is situated closer to flow channel 6 in the radial direction than an outer ring 16, which is provided at a distance from inner ring 15, also circumferentially around the flow channel. Inner ring 15 and outer ring 16 are essentially designed as cylindrical rings.

Inner ring 15 and outer ring 16 are connected to each other via an annular web or web ring 17, which is situated on inner ring 15 and on outer ring 16 in such a way that a C-shaped cross section of clamping ring 14 essentially results. In the illustrated exemplary embodiment of the appended drawing, web ring 17 is situated on the left edges of inner ring 15 and outer ring 16. Web ring 17 may, of course, also be situated on the other side of inner ring 15 and outer ring 16. Web ring 17 is situated diagonally opposite outer ring 16 and has a kinked area 21 in the area of the connection to inner ring 15, so that a certain flexibility results under a radial load, making it possible to reduce the distance between outer ring 16 and inner ring 15 by correspondingly bending web ring 17 or pivoting inner ring 15 in relation to kink 21. For this purpose, the web ring may alternatively have a bent area or even a curved design.

Clamping ring 14, which may be designed either as a closed ring surrounding flow channel 6 or as an open ring in the form of a tension ring having an interruption in the circumferential direction, has form-locked elements in the form of clamping ring fasteners 19 and lining fasteners 18, which engage with housing 1, on the one hand, and with lining segment 11, on the other hand, on the ends of the cross-sectional C-shaped structure of the clamping ring. A structure, which has a forked shape in the axial sectional view and which surrounds a recess with which lining fastener 18 of clamping ring 14 may engage, is provided for this purpose on the lining segment.

A circumferential securing on the housing may furthermore be implemented by a form-locked element in at least one circumferential location and/or by a friction and/or press fitting of clamping ring 14.

Lining element 11 has a contact surface 22 which abuts the outer surface of inner ring 15. A clamping element 20, which also has a C-shaped cross section, is situated between lining element 11 or heat protection panel 12, situated downstream therefrom in the direction of housing 1, and the inner surface of outer ring 16, clamping element 20 pressing outer ring 16 and heat protection panel 12 or lining 11 and inner ring 15 away from each other. Contact surface 22 of lining segment 11 is thus pressed against the outer surface of inner ring 15. This causes a sealing of the area between lining segment 11 and housing 1 against flow channel 6.

Additionally and independently of clamping element 20, clamping ring 14 may be situated under compression stress in such a way that inner ring 15 presses against contact surface 22 of lining segment 11 to form a seal.

Additionally situated on the radial inside of inner ring 15 is a sealing ring 23 which engages with a sealing groove 24, which is provided, for example, on shroud 25 of a stator for the purpose of sealing the area between housing segment 2 and stator shroud 25 against flow channel 6.

During operation, hot fluid flows through flow channel 6, so that inner ring 15 of clamping ring 14 heats to a higher temperature than outer ring 16 of clamping ring 14. Due to the thermal expansion, inner ring 15 undergoes greater deformation than outer ring 16, so that the distance between inner ring 15 and outer ring 16 may be reduced due to an elastic deformation in kinked area 21 of web ring 17 and/or in the connecting area between web ring 17 and outer ring 16. Due to the greater deformation of inner ring 15, inner ring 15 is pressed radially to the outside for the purpose of pressing against contact surface 22 of lining segment 11. This ensures that a sufficient contact is provided between contact surface 22 and the outer surface of inner ring 15 even at higher operating temperatures, so that the seal may be maintained.

Although the present invention was described in detail on the basis of the appended exemplary embodiment, it is a matter of course to those skilled in the art that the present invention is not limited to this exemplary embodiment, but instead modifications and changes are possible in such a way that individual features may be omitted or different combinations of features may be implemented, without departing from the scope of protection of the appended claims.

What is claimed is:

1. A turbomachine comprising:

a flow channel;

a housing radially surrounding the flow channel;

at least one liner being situated between the flow channel and the housing;

a stator shroud spaced apart from the at least one liner in a radial direction;

a rotor shroud spaced apart from the at least one liner in the radial direction; and at least one clamping ring situated at least partially circumferentially around the flow channel to abut at least one contact surface of the at least liner;

wherein the clamping ring includes an outer ring and an inner ring spaced a distance apart in the radial direction;

wherein the outer ring and the inner ring are connected to each other via an annular web situated on a same side of front edges of the outer and inner rings to form a cross-sectional C-shape;

wherein the contact surface of the liner abuts a radially outer surface of the inner ring;

wherein the inner ring, outer ring, and annular web are positioned such that, during operation of the turbomachine, thermal expansion due to heating of the inner ring results in the inner ring being moved radially outward towards the outer ring to press against the contact surface of the liner sealing the flow channel.

2. The turbomachine as recited in claim 1 wherein the clamping ring surrounds the flow channel circumferentially.

3. The turbomachine as recited in claim 1 further comprising at least one clamp situated between the outer ring and the inner ring, the clamp contacting an outer radial surface of the liner.

4. The turbomachine as recited in claim 1 wherein the liner is held in a clamped manner between the outer ring and the inner ring and contacts the inner ring.

5. The turbomachine as recited in claim 1 wherein the annular web has a curved area or a kink, in relation to which the inner ring is pivotable in such a way that at least edges of the outer and inner rings located opposite the annular web are variable in terms of their distance.

6. The turbomachine as recited in claim 1 wherein the clamping ring has form-locked elements for connecting adjacent components.

7. The turbomachine as recited in claim 1 wherein the clamping ring is accommodated in the housing under compression stress.

8. The turbomachine as recited in claim 1 wherein the clamping ring forms a single piece with the housing.

9. The turbomachine as recited in claim 1 further comprising a sealing ring contacting a radially inner surface of the inner ring.

10. The turbomachine as recited in claim 1, further comprising a run-in coating attached to the at least one liner;

a seal tip on the rotor shroud opposite the run-in coating.

11. The turbomachine as recited in claim 1, further comprising a sealing ring on a radially inner side of the inner ring, the sealing ring engaging the stator shroud.

12. A turbomachine comprising:

a flow channel;

a housing radially surrounding the flow channel;

at least one liner being situated between the flow channel and the housing;

a stator shroud spaced apart from the at least one liner in a radial direction;

a rotor shroud spaced apart from the at least one liner in the radial direction; and at least one clamping ring situated at least partially circumferentially around the flow channel to abut at least one contact surface of the at least one liner;

wherein the clamping ring includes an outer ring and an inner ring spaced a distance apart in the radial direction;

wherein the outer ring and the inner ring are connected to each other via an annular web situated on a same side of front edges of the outer and inner rings to form a cross-sectional C-shape;

the inner ring being freely supported by the outer ring via the annular web to permit the inner ring to move relatively toward to the outer ring;

wherein the inner ring and the at least one liner separate the flow channel from the housing.

13. The turbomachine as recited in claim 12 wherein the annular web has a kink.

14. The turbomachine as recited in claim 12, further comprising a run-in coating attached to the at least one liner;

a seal tip on the rotor shroud opposite the run-in coating.

15. The turbomachine as recited in claim 12, wherein the inner ring, outer ring, and annular web are positioned such that, during operation of the turbomachine, thermal expansion due to heating of the inner ring results in the inner ring being moved radially outward towards the outer ring to press against the contact surface of the liner sealing the flow channel.

16. The turbomachine as recited in claim 15, further comprising a run-in coating attached to the at least one liner;

a seal tip on the rotor shroud opposite the run-in coating.

17. The turbomachine as recited in claim 12, further comprising a sealing ring on a radially inner side of the inner ring, the sealing ring engaging the stator shroud.

* * * * *